US006200219B1

(12) United States Patent
Rudell et al.

(10) Patent No.: US 6,200,219 B1
(45) **Date of Patent: *Mar. 13, 2001**

(54) TOY VEHICLES WITH INTEGRAL MOTION SENSITIVE GAME DISPLAY

(75) Inventors: Elliot Rudell, 1619 Gramercy Ave., Torrance, CA (US) 90501; George Foster, Long Beach; Richard Kamrath, Rolling Hills Estates, both of CA (US)

(73) Assignee: Elliot Rudell, Torrance, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/189,617

(22) Filed: Nov. 9, 1998

Related U.S. Application Data

(63) Continuation-in-part of application No. 09/095,402, filed on Jun. 10, 1998.

(51) Int. Cl.[7] ..... A63B 9/00

(52) U.S. Cl. ..... 463/37; 463/6; 463/7; 463/36; 273/148 B; 345/156; 345/157; 345/163

(58) Field of Search ..... D14/117.1–117.9; 463/6, 7, 36, 37, 43–47; 273/148 B; D21/324, 329, 424; 345/156–157, 163

(56) References Cited

U.S. PATENT DOCUMENTS 5,059,958 * 10/1991 Jacobs et al. ..... 340/706
5,526,481 * 6/1996 Parks et al. ..... 395/155
5,692,956 * 12/1997 Rifkin ..... 463/37

* cited by examiner

*Primary Examiner*—Jessica J. Harrison
*Assistant Examiner*—Carmen D. White
(74) *Attorney, Agent, or Firm*—Irell & Manella LLP

(57) ABSTRACT

A hand held electronic game which includes a vehicle that can be moved by a player. The vehicle may have a visual display which displays a graphic image. The video game may further have a sensor that senses the motion of a vehicle axle and a processor which varies the graphic image in response to the detected motion of the vehicle to simulate the motion of the vehicle.

12 Claims, 5 Drawing Sheets

TOY VEHICLES WITH INTEGRAL MOTION SENSITIVE GAME DISPLAY

CROSS REFERENCE TO RELATED APPLICATIONS

This application is a Continuation-in-Part of application Ser. No. 09/095,402, filed on June. 10, 1998, now pending.

BACKGROUND OF THE INVENTION

1. Field of the Invention

The present invention relates to a hand held electronic game with an interactive image display.

2. Background Information

There have been developed and marketed various electronic games which provide interactive three dimensional simulation. For example, there are games which provide a graphic image of a vehicle moving relative to a background image. A game participant may sit in a seat, such as on a motorcycle, that faces a relatively large screen which depicts related images including a graphic image of a motorcycle. The game may further have a handlebar and an accelerator throttle that can be manipulated by the player to vary the position of the graphic motorcycle image. Such games are relatively large and expensive to purchase. For this reason these products are typically limited to use within an arcade or other entertainment center.

There has been marketed a number of hand held electronic games with image display. For example, Tiger Games has marketed products under the trademarks TIGER MINI-BASEBALL and TIGER MINI-STOCK RACING which allows a player to move a dot relative to a graphic image such as a baseball diamond or a race track, respectively. The games may have buttons which allow the player to move the dot.

Radica Games has marketed a hand held electronic game under the name BASS FISHIN'. In general, a player will move the game through the air to simulate the casting of a fishing pole. The game contains a microprocessor, motion sensors, and a liquid crystal display (LCD) which can display data based on the actual casting motion of the game. BASS FISHIN' also contains a reel handle that can be rotated by the player to simulate the sensation of catching a fish. A simulated lake and fish are displayed by the LCD to provide visual assistance to the player, but these images are not altered in direct response to the actions of the player. The graphic image only changes after a "cast," or the rotation of the reel. There is not a continuous variation in the graphic image and movement of the hand held unit.

Mattel Toys has marketed a toy vehicle which has an LCD that displays messages such as "fill gas tank", "change tires". Schaper marketed a toy vehicle which contained a timer and an LCD that displayed the time the vehicle traveled across a playing surface.

None of the hand held electronic games of the prior art provide an interaction between a movement of the game unit and the image displayed by the game. It would be desirable to provide a hand held electronic game that continuously varies a graphic image as the entire game is being moved by a player, wherein the varying graphic image provides a simulated motion of the game.

SUMMARY OF THE INVENTION

One embodiment of the present invention is a hand held toy which includes a vehicle that can be moved by a player.

The vehicle may have a visual display which displays a graphic image. The video game may further have a sensor that senses the motion of a vehicle axle and a processor which varies the graphic image in response to the detected motion of the vehicle to simulate the motion of the vehicle.

DETAILED DESCRIPTION OF THE INVENTION

One embodiment of the present invention is a hand held toy which includes a vehicle that can be moved by a player. The vehicle may have a visual display which displays a graphic image such as an image of the vehicle or a background image as seen by a "driver" of the vehicle. The toy may further have a sensor that senses the movement of the vehicle and a processor which varies the graphic image to simulate the motion of the vehicle. The display, sensor and processor are all attached to the vehicle to create a hand held unit.

To operate the toy the processor may perform a software routine which causes the graphic image to move in response to movement of the vehicle. The player may move the vehicle and the corresponding vehicle image to successfully complete a game such as "racing" the vehicle around a track. The software routine may introduce variations in the background image such as another car or an obstacle in the track image. The player must then move the vehicle and the corresponding vehicle image to avoid the other car or obstacle.

Figure 1:
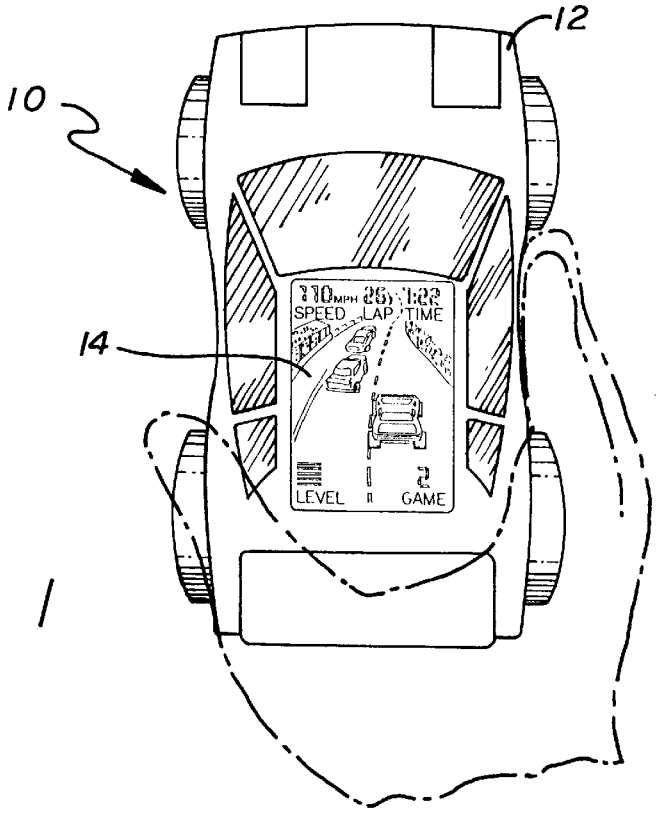
FIG. 1 is a top view of an embodiment of a hand held electronic toy of the present invention.
Figure 2:
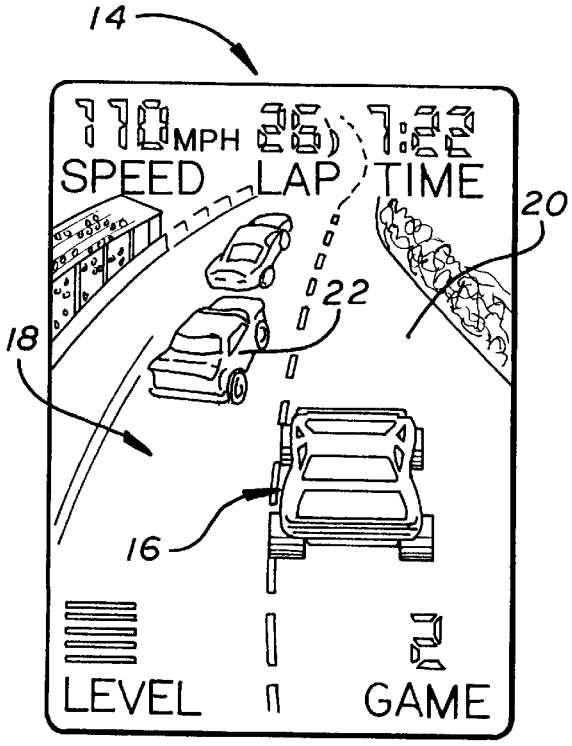
FIG. 2 is a top view of a visual display of the toy.

Referring to the drawings more particularly by reference numbers, FIGS. 1 and 2 show an embodiment of a hand held toy 10 of the present invention. The hand held toy 10 may be constructed to simulated a toy vehicle 12 such as an automobile. Although a toy automobile is shown and described, it is to be understood that the toy vehicle can be constructed to simulate a boat, an airplane or any other apparatus.

The toy 10 may include a visual display 14 located on a top surface of the vehicle 12. Locating the visual display 14 on the top surface allows a player to see the display even when the toy vehicle 12 is moving. The visual display 14 may depict a graphic image 16 of the toy vehicle 12 within a background image 18. By way of example, the background image 18 may include a road image 20 and other vehicle images 22.

Movement of the toy vehicle 12 may cause the vehicle graphic image 16 to move relative to the background image 18. For example, if a player moves the toy vehicle 12 in a forward direction the toy 10 may cause the vehicle image 16 to move in a forward direction relative to the background image 18. A leftward movement of the toy vehicle 12 may cause the vehicle image 16 to move to the left within the background image 18.

Figure 3:
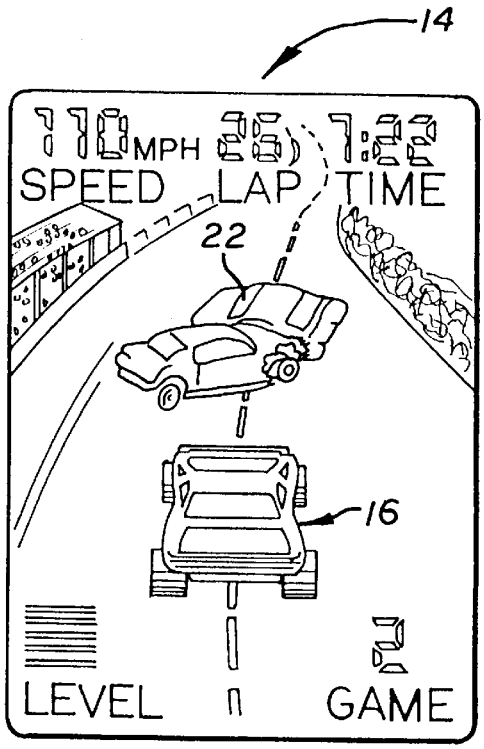
FIG. 3 is a top view of the visual display showing a different displayed image.

As shown in FIG. 3, the toy 10 may vary the background image 18 so that the player must respond with a corresponding movement of the toy vehicle 12 and the vehicle image 16. For example, the other vehicle images 22 may "crash" in front of the vehicle image 16. The crash would require the player to move the toy vehicle 12 and corresponding image 16 to avert the other vehicle images 22. The video game can thus vary the skill level of playing the game by changing the background image 18.

FIG. 3A shows an alternate embodiment wherein the visual display 14 does not display an image of the entire vehicle. The graphic image may include a front portion 12' of a simulated vehicle as seen by a driver of the vehicle. The display 14 may also provide a background image 18 as seen by a driver of the vehicle. The background image 18 may change in correspondence with a movement of the vehicle by a player to simulate the motion of the vehicle.

Figure 4:
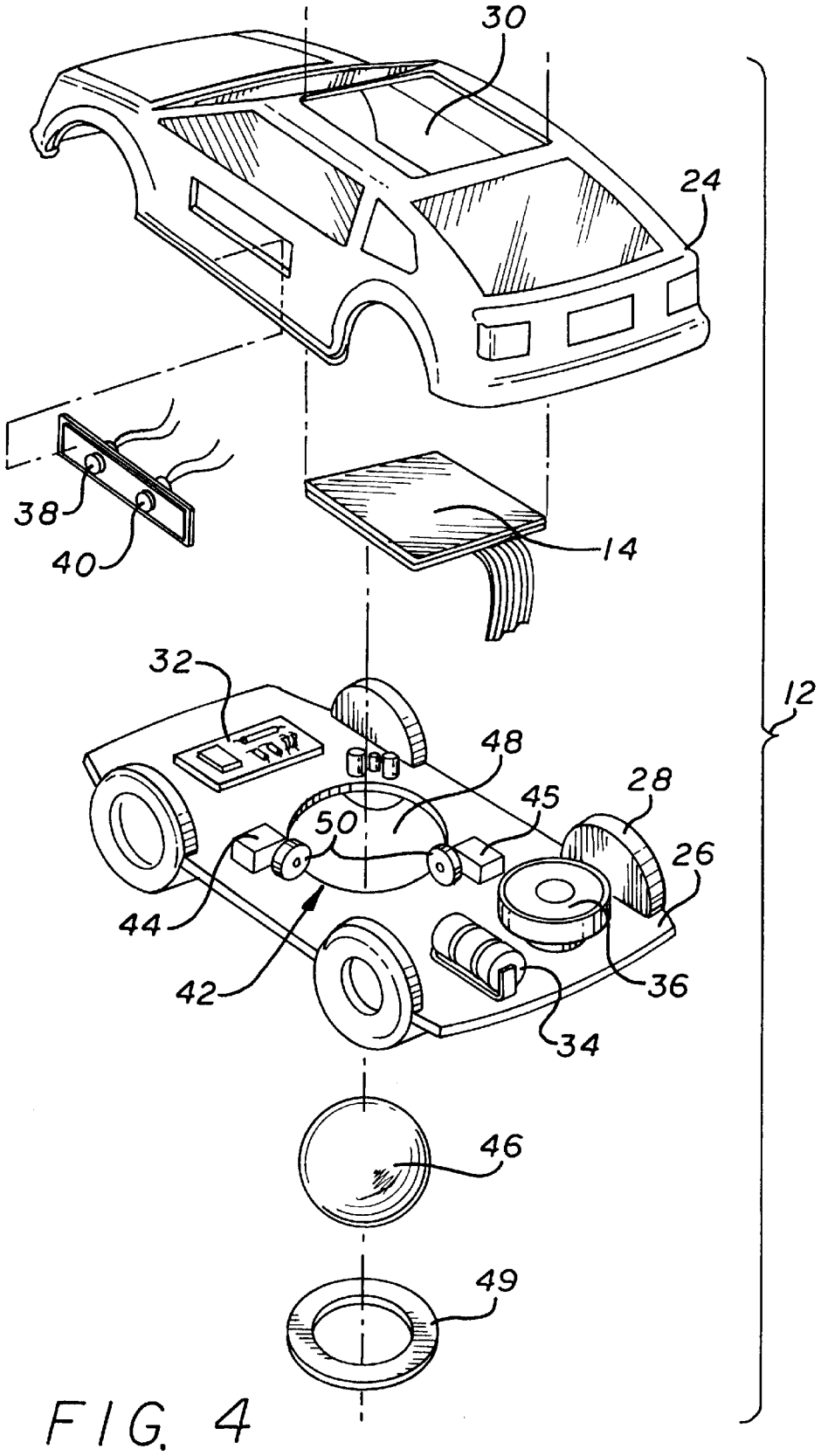
FIG. 4 is an exploded view of an embodiment of the toy.

FIG. 4 shows an embodiment of the toy vehicle 12. The toy vehicle 12 may include a body 24 that is attached to a chassis 26. The chassis 26 may have four wheels 28. The visual display 14 may be located within an opening 30. The visual display 14 may be a liquid crystal display (LCD) panel. The display 14 may be coupled to a printed circuit board assembly 32 and a battery(ies) 34. The printed circuit board assembly 32 may also be connected to a speaker 36 and a pair of input buttons 38 and 40. The circuit board assembly 32 may include electronic circuits which drive the visual display 14 and create sound through the speaker 36.

The circuit board assembly 32 may also be coupled to a sensor 42 that senses a movement of the toy vehicle 12. The sensor 42 may include an x motion detector 44 and a y motion detector 45 that are coupled to a ball 46. The ball 46 may extend through an opening 48 in the chassis 26. The ball 46 may be coupled to the chassis 26 by a retainer ring 49. The detectors 44 and 45 provide electrical signals to the circuit board 32 which correspond to a movement of the ball 46. The detectors 44 and 45 may each have a wheel 50 that rotates with the ball 46.

Figure 5:
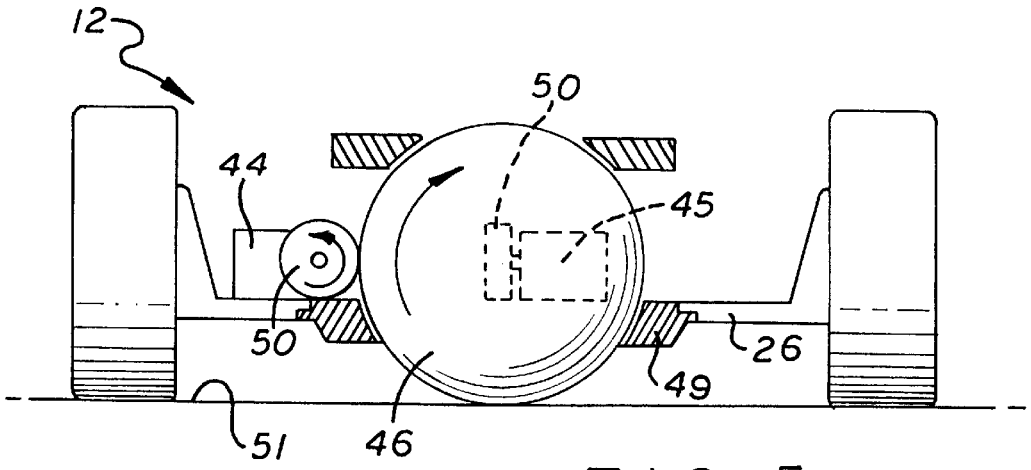
FIG. 5 is a side view showing a sensor of the toy.

As shown in FIG. 5, movement of the toy vehicle 12 along a playing surface 51 rotates the ball 46 and spins one or both detector wheels 50. Rotation of a detector wheel(s) 50 provides a corresponding input signal(s) to the printed circuit board assembly 32. The circuit board assembly 32 then processes the input signal(s) to vary the position of the vehicle image displayed by the visual display. The circuit board assembly 32 may also process a time rate of change of the vehicle 12, and then set or vary the simulated velocity or acceleration of the graphic image(s).

Referring to FIG. 4, the input buttons 38 and 40 may be depressed to provide input signals to the circuit board assembly 32. Input button 38 may be an "acceleration" button which causes the vehicle image to move, or move faster relative to the background image. Input button 40 may be a "brake" button which causes the vehicle image to slow down and/or stop relative to the background image.

Figure 6:
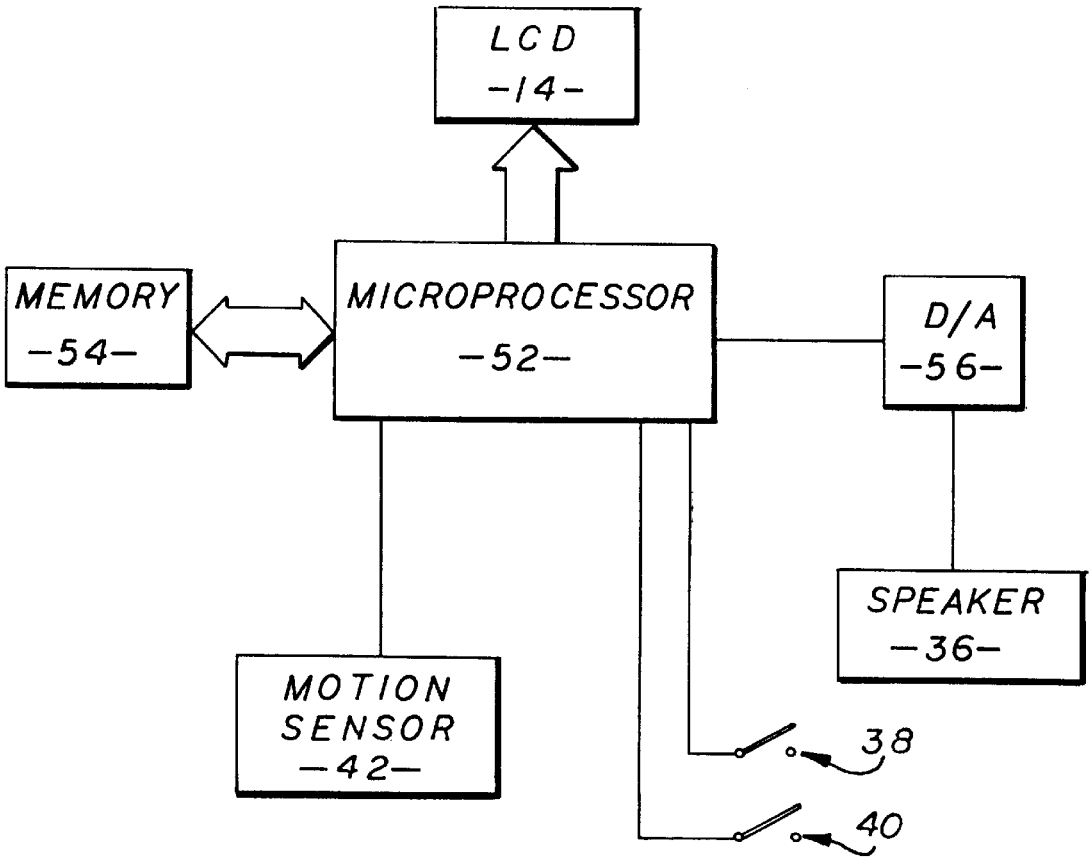
FIG. 6 is a schematic showing an electronic system of the toy.

FIG. 6 shows an electronic system for the toy 10. The system may include a microprocessor 52 that is coupled to a memory device(s) 54. The memory device 54 may be a read only memory (ROM) integrated circuit which contains software instructions for the microprocessor 52. The microprocessor 52 may perform software routines in conjunction with the instructions stored in the memory device 54.

The processor 52 may be coupled to the visual display 14. The processor 52 may drive the display to depict the graphic images in accordance with the software routine(s). The processor 52 may also drive the speaker 36 through a digital to analog (D/A) converter 56. The processor 52 may drive the speaker 36 to emit sounds such as the crashing of a vehicle. The processor 52, memory and D/A 56 may be incorporated into the printed circuit board assembly.

The processor 52 may be connected to the sensor 42 and the input buttons 38 and 40. The processor 52 may utilize input signals from the sensor 42 and/or buttons 38 and 40 to vary the relative position of the vehicle image relative to the background image.

Figure 7:
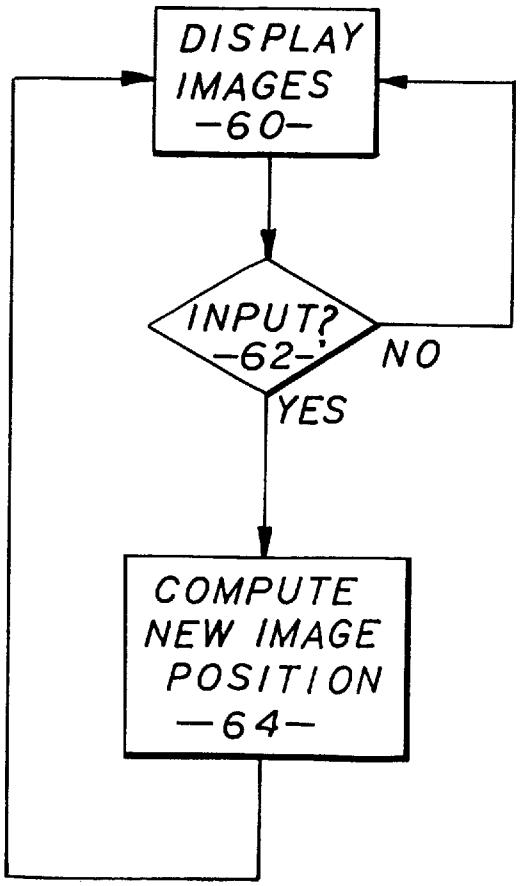
FIG. 7 is a flowchart showing an operation of the toy.

FIG. 7 shows a routine performed by the processor 52. The visual display is driven to display a vehicle image and a background image in step 60. The process then determines whether there has been an input signal from the sensor 42, or buttons 38 and 40 in decision block 62. If no input signals are received the process returns to step 60 and continues to display the vehicle and background images.

If an input signal(s) is received the processor 52 computes a new position of the vehicle image relative to the background image in process block 64. The process then returns to step 60 to provide the new image on the visual display. The processor 52 can compute a new relative position by varying the vehicle image, the background image, or both.

Referring to FIG. 2, the video game may display data relating to the players performance of the game. For example, the game may display the "speed" of the vehicle image relative to the background image, along with the number of laps completed and an elapsed time. The game may have an input button (not shown) which allows the player to vary the skill level of the game. Varying the skill level may vary the software routine performed by the microprocessor 52.

Figure 8:
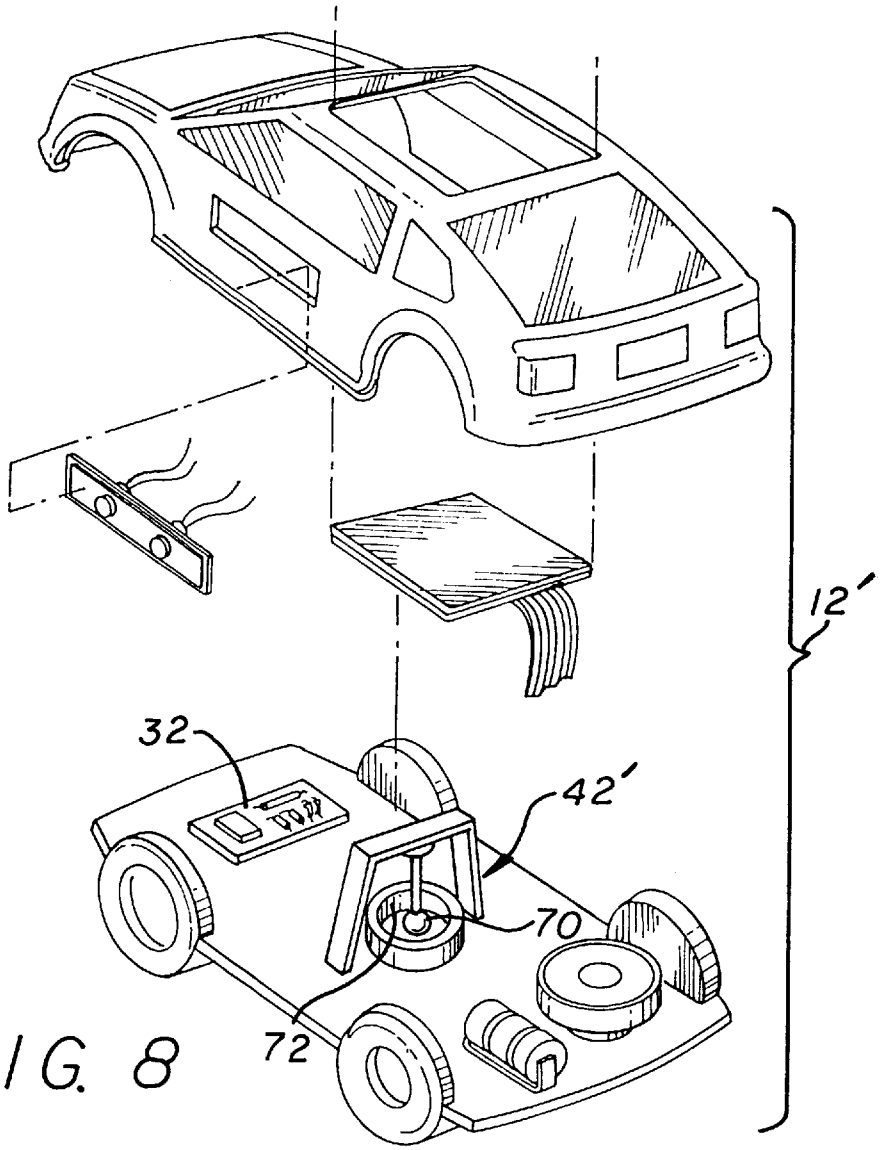
FIG. 8 is an exploded view of another embodiment of the toy.

FIG. 8 shows another embodiment of the toy vehicle 12' which has a pendulum based sensor 42'. The sensor 42' may include an electrically conductive pendulum 70 that can rotate into one of a plurality of electrical contacts 72. The pendulum 70 and contacts 72 may be coupled to the circuit board assembly 32. Movement of the pendulum 70 into a contact 72 may provide an input signal to the circuit board assembly 32 to vary the position of the vehicle image. Although an electrical pendulum 70 and contacts 72 are shown and described, it is to be understood that the contacts may be pressure sensors which provide input signals in response to pressure from the pendulum.

Figure 9:
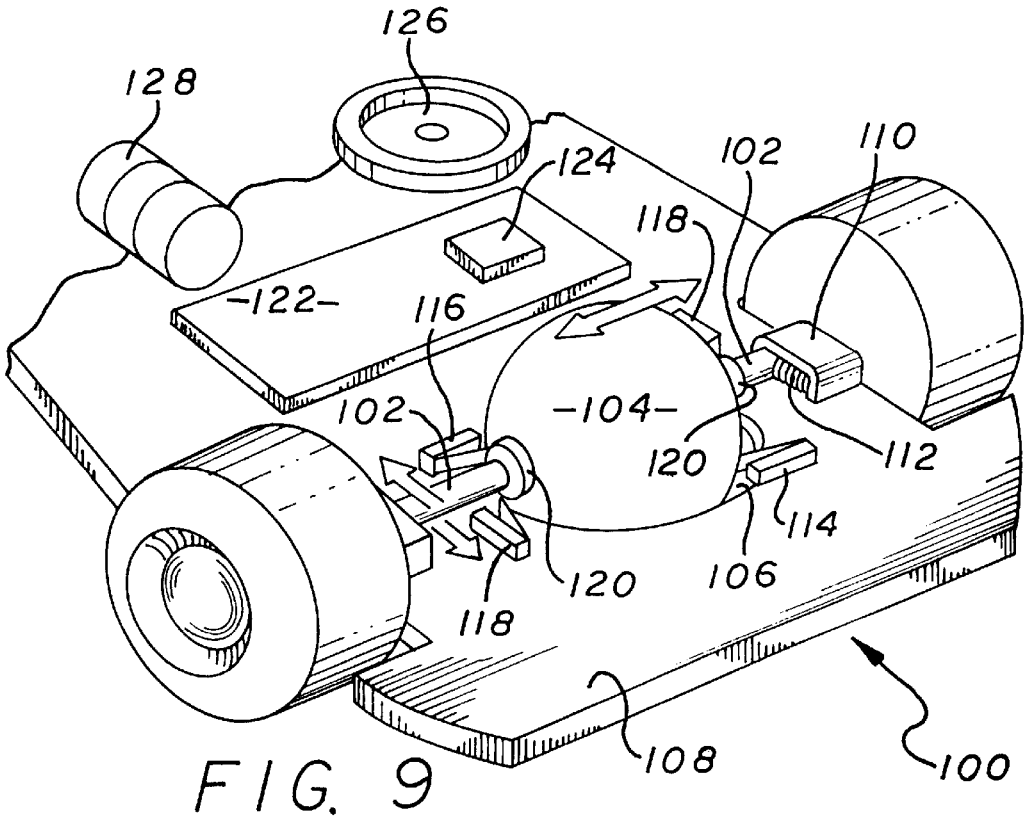
FIG. 9 is a perspective of another embodiment of the toy.

FIG. 9 shows another embodiment of a toy vehicle 100 which has a pair of axles 102 that are attached to a ball 104. The ball 104 extends through an opening 106 of a vehicle housing 108. The axles 102 may be captured by axle yokes 110 of the housing 108 and biased into aft positions by springs 112.

The toy 100 may have a forward contact switch 114 and a rearward contact switch 116 that are located adjacent to the ball 104. The toy 100 may also have a pair of lateral contact switches 118 that are coupled to collars 120 of each axle 102.

The contact switches 114, 116 and 118 are connected to a printed circuit board assembly 122 that may include a microprocessor 124. The toy 100 may also include a speaker 126 and batteries 128 that are connected to the board assembly 122.

When the toy 100 is moved across a playing surface the ball 104 and axles 102 may slightly move in a fore or aft direction as indicated by the arrows. Movement of the ball 104 may close one of the contact switches 114 or 116. The closed switch 114 or 116 provides an input signal to the microprocessor 124 to detect the motion of the toy 100. Likewise a side to side movement of the toy 100 will induce a lateral shift of the axles 102 and cause one of the axle collars 120 to engage and close one of the contact switches 118. The closed switch 118 provides an input signal to the microprocessor 124 to detect lateral movement of the toy 100. Although a ball 104 is shown, it is to be understood that the axles 102 can be coupled to wheels 130 that roll along a playing surface.

Figure 10:
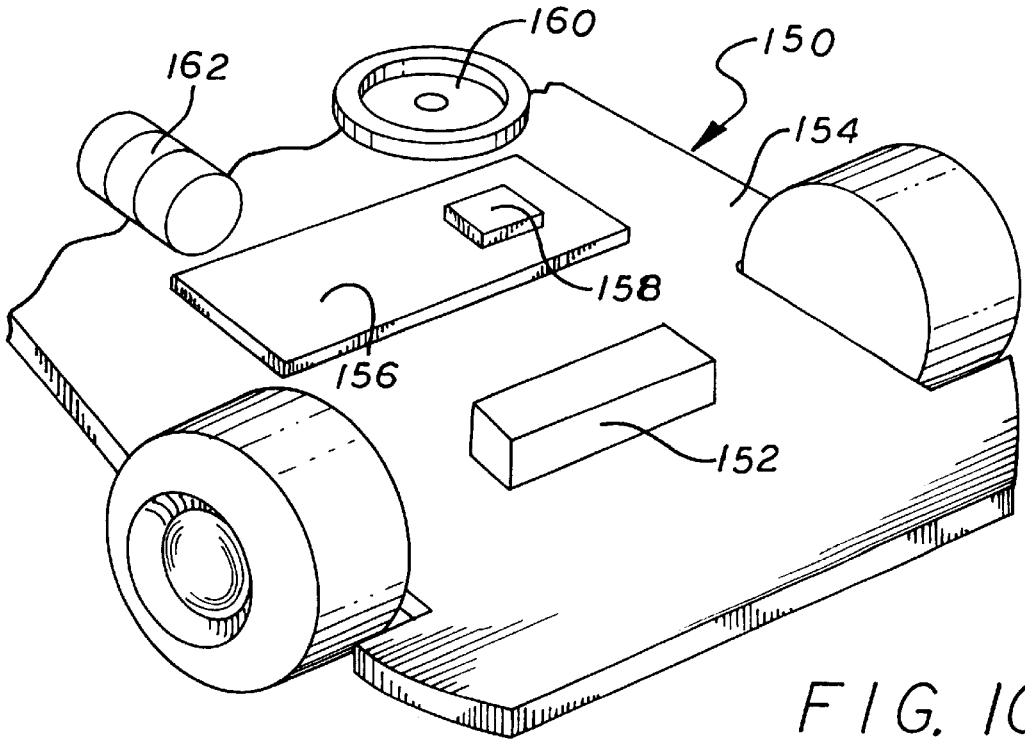
FIG. 10 is a perspective view of another embodiment of the toy.

FIG. 10 shows another embodiment of a toy 150 which has a mercury switch sensor 152 that can sense the motion of a vehicle housing 154. The mercury switch sensor 152 can be connected to a printed circuit board assembly 156 which has a microprocessor 158. The toy 150 may also have a speaker 160 and batteries 162. In operation the mercury switch sensor 152 provides an input signal to the microprocessor 158 when the vehicle is moved either in the air or along a playing field.

Although a mercury switch sensor is disclosed it is to be understood that item 152 may be another sensing device such as an optical sensor.

The embodiments shown in FIGS. 9 and 10 contain the visual displays shown in FIGS. 1–3A. These embodiments may also have other features shown in FIGS. 1–8 such as the input buttons.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A hand held toy, comprising:

a vehicle housing;

an axle that is coupled to said vehicle housing;

a visual display that is attached to said vehicle housing and which displays a graphic image;

a sensor that can sense a motion of said axle; and, a processor that can vary a position of the graphic image in response to the detected motion of said axle.

2. The toy of claim 1, further comprising a ball that is attached to said axle.

3. The toy of claim 1, wherein said sensor includes a contact switch.

4. The toy of claim 2, wherein said axle includes a collar that is coupled to said contact switch.

5. The toy of claim 1, further comprising an input button that is coupled to said processor, said processor varies the graphic image displayed by said visual display when said input button is depressed.

6. The toy of claim 1, further comprising a speaker that is coupled to said processor.

7. A hand held toy, comprising:

a vehicle housing;

an axle that is coupled to said vehicle housing;

a wheel that is attached to said axle;

a visual display that is attached to said vehicle housing and which displays a graphic image;

a sensor that can sense a motion of said vehicle housing; and, a processor that can vary a position of the graphic image in response to the detected motion of said vehicle housing.

8. The toy of claim 7, further comprising a ball that is attached to said axle.

9. The toy of claim 7, wherein said sensor includes a contact switch.

10. The toy of claim 7, wherein said axle includes a collar that is coupled to said contact switch.

11. The toy of claim 7, further comprising an input button that is coupled to said processor, said processor varies the graphic image displayed by said visual display when said input button is depressed.

12. The toy of claim 7, further comprising a speaker that is coupled to said processor.

* * * * *